United States Patent [19]

Sumita et al.

[11] 4,148,349

[45] Apr. 10, 1979

[54] METHOD FOR CONTROLLING SLIPPAGE BETWEEN ROLLS AND A SLAB IN A CONTINUOUS COMPRESSION CASTING APPARATUS

[76] Inventors: Yutaka Sumita, No. 2226, Higashiakeno; Seiichi Watanabe, No. 2426-2, Higashiakeno, both of Ohita City, Ohita Pref., Japan

[21] Appl. No.: 794,184

[22] Filed: May 5, 1977

[30] Foreign Application Priority Data

May 8, 1976 [JP] Japan ..... 52/373
May 8, 1976 [JP] Japan ..... 52/374

[51] Int. Cl.[2] ..... B22D 11/16

[52] U.S. Cl. ..... 164/4; 164/82; 164/413; 164/448

[58] Field of Search ..... 164/4, 72, 82, 154, 164/413, 442, 76, 448; 29/527.7

[56] References Cited

U.S. PATENT DOCUMENTS

| | | | |
|---|---|---|---|
| 3,543,830 | 12/1970 | Baumann | 164/82 |
| 3,752,210 | 8/1973 | Gallucci et al. | 164/413 X |
| 3,776,298 | 12/1973 | Vogt | 164/442 X |
| 3,861,456 | 1/1975 | Gallucci et al. | 164/442 X |
| 4,030,531 | 6/1977 | Wunnenberg | 164/4 |

FOREIGN PATENT DOCUMENTS

| | | | |
|---|---|---|---|
| 5098432 | 5/1975 | Japan | 164/413 |

*Primary Examiner*—William R. Briggs
*Attorney, Agent, or Firm*—Wenderoth, Lind & Ponack

[57] ABSTRACT

In a continuous compression casting process for making a casting slab such as steel, the problem of the occurrence of slippage; between the casting slab and the rolls is effectively overcome by a control means for releasing or gradually decreasing the braking action of the braking rolls.

7 Claims, 2 Drawing Figures

METHOD FOR CONTROLLING SLIPPAGE BETWEEN ROLLS AND A SLAB IN A CONTINUOUS COMPRESSION CASTING APPARATUS

DETAILED DESCRIPTION OF THE INVENTION

Figure 1:
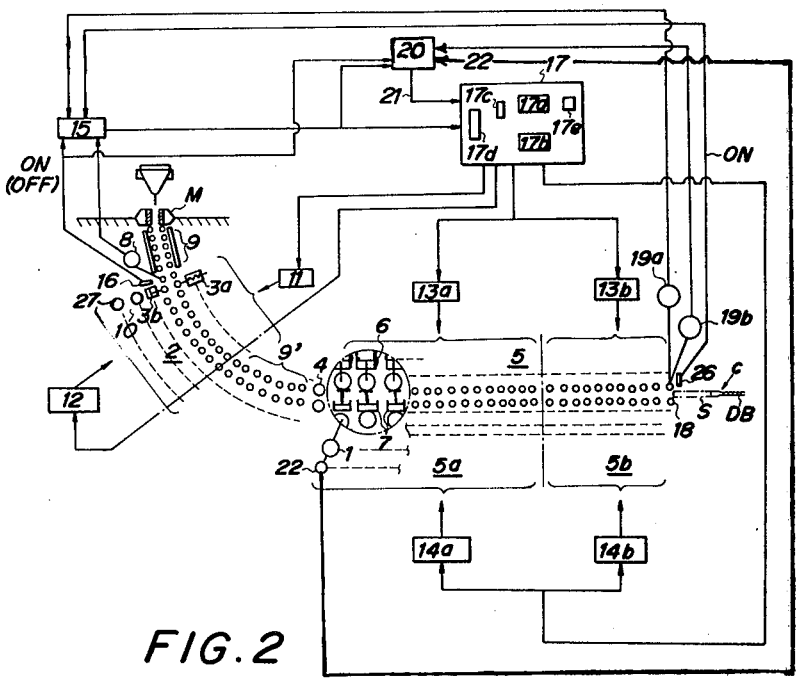

This invention relates to a method for continuous compression casing.

In the curved or bending type continuous casting methods, there occur cracks and flaws outside or inside the cast slab due to thermal strain, driving tension strain, bending-correction strain, bulging strain, etc. caused by high speed casting and the large size of the cast slab, etc. These cracks and flaws give rise to defects in the final product, which results in obstacles to the improvement of the yield and increased productivity.

Many attempts have heretofore been made to prevent such cracks, for example, improved selection of the bending profile, smaller of roll pitch, etc. but they have not been found to be feasible.

Prior art attempts to overcome the above disadvantages are shown in Japanese laid open application No. 98432/75 (Aug. 5, 1975 ) and Japanese Patent Application No. 40523/76 (Apr. 10, 1976).

The former publication discloses a method for continuous casting which comprises driving a casting slab by means of driving pinch rolls placed upstream of the straightening point in a guiding zone in a continuous casting unit, effecting a braking control of the moving slab by means of braking rolls placed downstream of said straightening point for longitudinally compressing the part of said slab positioned at the straightening point and in the vicinity thereof.

The latter publication discloses a method for continuous compression casting which comprises utilizing the history of the casting of the slab before it reaches the straightening point or the history of each longitudinal part thereof, namely (a) the molten metal temperature in the mold, (b) the kind of the slab, (c) change in the amount of cooling water, (d) the change in the speed of casting, etc. so as to anticipate the condition of the shell formed on said slab, utilizing the bulging of the slab at this time to adjust the driving power of the driving pinch rolls upstream of the straightening point and the braking power of braking rolls downstream of the straightening point for applying compression to the part of said slab positioned at the straightening point.

However, the gap between the rolls of each pair of upper and lower rolls is usually set for a predetermined thickness of a slab to be produced since the driving pinch rolls and the braking rolls must not only support the slab during its shell-forming stage but also guide it during driving. Accordingly, if the bulging of the casting slab is erroneously utilized, slippage will sometimes occur between the slab and the driving pinch rolls or the braking rolls. As a result, a flaw caused by the slippage is generated on the surface of the slab and the quality of the slab surface is thus injured, whereby it becomes difficult to maintain the conditions for compression casting suitable for improving the quality of the internal part of the slab and an unstable control results therefrom.

It is therefore an object of this invention to overcome the disadvantages set forth above.

According to this invention there is provided a method for continuous casting wherein driving pinch rolls and braking rolls are provided upstream of a straightening point and downstream of the straightening point respectively of a slab-guiding part of a continuous casting apparatus the slab is driven by means of said driving pinch rolls while a braking operation for controlling the movement of said slab is carried out by means of said braking rolls whereby said slab is guided while compression is exerted in the longitudinal direction of the part of said slab positioned between the driving pinch rolls and the braking rolls and the braking action of the braking rolls is released or gradually decreased if slippage occurs between the casting slab and the driving pinch rolls or the braking rolls.

In the method according to this invention, the gap between the upper and lower rolls of said slab-guiding part is set to a predetermined value.

In the method according to this invention, when slippage occurs between the casting slab and the braking roll, the slippage is detected and in response to a slip-detecting signal at least one of the following steps are conducted;

(1) the braking action of the braking roll is released,
(2) the braking action of the braking roll is gradually decreased,
(3) the pressure of the braking rolls on the slab is gradually increased,
(4) the slab-driving velocity of said driving pinch rolls is gradually increased, whereby said slip is caused to disappear.

In the method according to this invention, when slippage occurs between the casting slab and the driving pinch rolls, the slippage is detected and in response to a slip-detecting signal at least one of the following steps are conducted;

(1) the braking action of the braking roll is released,
(2) the braking action of the braking roll is gradually decreased,
(3) the pressure of the driving pinch rolls on the slab is gradually increased, whereby said slip is caused to disappear.

Where the gap between the upper and lower rolls has been set to a predetermined value, the setting of the gap between the driving pinch rolls where slippage occurs can be ended and adjustment of the driving force can be achieved by a gradual increase of the pressure of the driving rolls on the slab, whereby said slip is caused to disappear.

Figure 2:
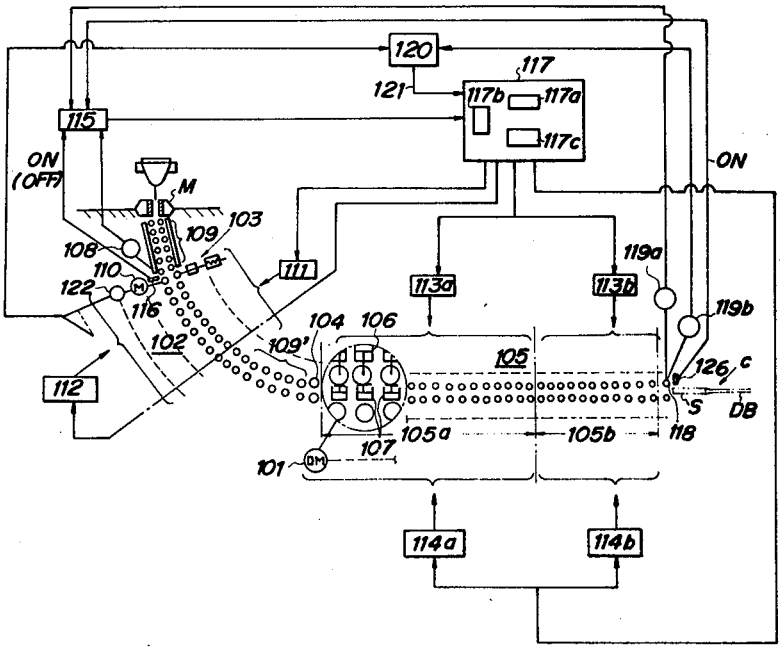

This invention will be further described with respect to the drawings, in which:

FIGS. 1 and 2 are schematic views illustrating preferred embodiments of apparatus for carrying out the methods of this invention.

In one aspect of this invention, when slippage occurs between the braking roll and the casting slab in a process wherein (a) the between the driving pinch rolls upstream of the straightening point and between the braking rolls downstream of the straightening point of the part of the continuous casting apparatus for guiding the slab being cast is set at a predetermined value and (b) the braking operation is carried out by the braking rolls and the driving is done by the driving pinch rolls so as to impart longitudinal compression to the part of the slab being cast which is located at or near the straightening point, said slippage is detected, and the braking action of the braking rolls is stopped or gradually decreased in response to the slip-detecting signal, or the set condition of the roll gap is ended and adjustment is carried out by gradual increase of the pressure of the driving rolls on the slab and/or the gradual increase of the slab driving velocity of the driving pinch rolls, so that said slippage is obviated. An example of an apparatus for carrying out this method is shown in FIG. 1.

In FIG. 1 is shown a bending type continuous casting apparatus in which M is a mold and 2 is a group of driving pinch rolls having respective driving motors 10 and tachogenerators 27 (the driving motors and tachogenerators for the upper pinch rolls are not shown). As a means to adjust and set the gap between each pair of rolls there are provided screw units 3*a* for the inner rolls and oil cylinder units 3*b* for the outer rolls along the bending arc along which the slab is moved. A pair of bending rolls 4 is provided at a straightening point at which the curved slab is straightened, and downstream thereof along the path of movement of the slab is a group of braking rolls 5 each having its own motor 1 which is capable of driving the slab with a positive driving torque or instead generating electricity by being rotated by the moving slab which is in pressure contact therewith so as to generate a braking force by a negative driving torque. There are also respective oil cylinder units 6 for the upper rolls and ram-cylinder type spacers 7 between the outer and lower rolls as means for adjusting and setting the gap between the respective pairs of braking rolls. The group of rolls 5 is further divided into a first braking roll group 5*a* and a second braking roll group 5*b*. The numeral 9 indicates a group of rolls provided between the mold M and the driving pinch roll group 2, and 9' indicates a group of rolls between the driving pinch roll group 2 and the first braking roll group 5*a*.

Control units are associated with the driving pinch roll group 2, and are constituted by an operation control unit 11 for controlling the units 3*a* for controlling the roll gaps and a control unit 12 for the driving motors. Similarly, the first and the second braking roll groups 5*a* and 5*b* are provided with operation control units 13*a* and 13*b* for controlling the roll gaps and with motor control units 14*a* and 14*b* respectively. A unit 15 for locating the position of a material receives a signal from a pulse generator 8 connected to any one of the rolls of the group 9, which is then transmitted to a control apparatus 17 in response to an ON signal from a material-detector 16 provided on the inlet end of the group 2. The signal introduced from the pulse generator 8 is switched to a signal introduced from a pulse generator 19*a* connected to an idle roll 18 following the second braking roll group 5*b* at the time that the cast slab passes the roll 18 and the ON signal is changed to an OFF signal indicating passage of the end of the material. The unit 15 is reset to the original condition by means of an OFF signal indicating passage of the end of the material from a material detector 26 provided on the outlet side of the idle roll 18.

The control apparatus 17 has an instruction control part 17*a* for leading the slab, an instruction control part 17*b* for the roll gaps, a switching part 17*c*, an instruction control part 17*d* for timing and a switching part 17*e*. Before the casting operation starts a dummy bar having a thickness less than that of the slab is led through the rolls, and an instruction for setting the roll gaps for guiding the dummy bar is given to the control units 11, 13*a* and 13*b* of the respective roll groups by means of the control part 17*b*. The control unit 11 supplies oil at a hydraulic pressure of 140 Kg/cm$^2$ for the oil cylinder units 3*b* so that they are positioned at the stroke-end positions toward the center of the roll gap. Unit 11 also operates the screw units 3*a* so that the roll gaps before the hydraulic pressure in units 3*b* is released can be used for guiding the dummy bar while the roll gaps after such release will be same as the thickness of the slab. The control units 13*a* and 13*b* for the first braking roll group 5*a* and the second braking roll group 5*b*, respectively, are supplied with oil at a hydraulic pressure of 140 Kg/cm$^2$. The control units 13*a* and 13*b* operate oil cylinder units 6 engaging the upper rolls 5' and spacers 7 between the chocks of the rolls of the first braking roll group 5*a* and the second braking roll group 5*b* to release the hydraulic pressure in the cylinders of the spacers 7 to allow the pistons of the spacers 7 to move down until the space between the rolls 5' and 5" is a minimum and simultaneously to supply hydraulic pressure to the space above the pistons of the oil cylinder units to move the pistons downward to move the upper roll 5' in the downward direction. Thus, the roll gaps are set to a size suitable for guiding the dummy bar minimum contraction limit and are the spacers are positioned between the chocks of the respective rolls so that the roll gaps for guiding the dummy bar are obtained.

When the casting starts, the timing instruction control part 17*d* receives a signal from the unit 15; indicating passage of the connecting part C between the dummy bar DB and the slab S; it compares the same with the patterns of roll arrangements of the groups 2, 5*a* and 5*b*; and it introduces a signal for changing the roll gaps from the dummy bar thickness to the slab thickness to the control part 17*b* each time the part C reaches the respective roll gaps. At each of these times, the control part 17*b* will instruct the respective units 11, 13*a* and 13*b* to change the roll gap to a size suitable for guiding the slab by releasing the hydraulic pressure in the units 3*b* and by extending the spacers 7 by supplying the cylinders of the spacers 7 with hydraulic pressure to make the hydraulic pressure in the spacers 7 higher than that in the cylinders of the oil cylinder units 6. In addition, the control part 17*b* instructs the units 13*a* and 13*b* to change the relation of the hydraulic pressure between the spacers 7 and the oil cylinder units 6 so that the roll gaps between the upper and lower rolls 5' and 5" are suitable for guiding the slab being cast.

The control part 17*a* instructs the control unit 12 for the group 2 to drive the rolls of group 2 to drive the slab when the casting starts and also instructs the control units 14*a* and 14*b* of the first and the second braking roll groups 5*a* and 5*b* to drive the rolls of these groups to convey the dummy bar. Among the signals from the unit 15 to the control part 17*d*, only the changing signal produced when the connecting part C reaches the roll gaps of the first and the second braking roll groups 5*a* and 5*b* is introduced to the control part 17*c*, whereby the rotation of the motor control units 14*a* and 14*b* is switched for driving of the braking rolls for a braking action so that a predetermined braking action is caused.

In this way, the slab S is drawn in a predetermined velocity by the driving pinch roll group 2 and braked with a predetermined braking action by the roll groups 5*a* and 5*b* so that so-called compression casting can be effected. In the practice of this compression casting, when slippage occurs between the casting slab and one or more of the braking rolls of the groups 1 and 2, this is detected by a change in the corresponding tachogenerator 22 which is supplied to the slip detector 20. A signal 21 showing occurrence of the slippage from a slip detector 20 is introduced into, for example, the control part 17*a* under the control, as described later, of the switching part 17*c* of the control apparatus 17, and control part 17*a* then instructs under the control, as described later, of the switching part 17*e*, the control units 14*a* and 14*b* to change the braking action of the corresponding braking roll to release it so that the roll effects only an idling motion, or to gradually decrease the braking action until said signal 21 disappears. The phenomenon of slippage can thus be obviated.

When the signal 21 is introduced via the switching part 17*c* into the control part 17*b*, the control units 11, 13*a*, 13*b* for the corresponding braking rolls are instructed to release or gradually decrease the hydraulic pressure of the oil supplied to the spacers 7 and to gradually increase the hydraulic pressure of the oil supplied to the units 6 so as to press the corresponding braking roll against the surface of the cast slab under a pressure of 20 to 40 tons, which results in removal of said slippage phenomenon.

The switching part 17*c* can be switched to supply signal 21 to both or either one of the control parts 17*a* and 17*b* manually, or automatically according to the preset value of the casting velocity, the braking effect, etc. when slippage occurs. Similarly, the switching part 17*e* can be switched to supply the signal from control part 17*a* to both or either one of the control units 14*a*, 14*b* side and the control unit 12 manually or automatically according to a preset value of the casting the braking effect or other appropriate factors when slippage occurs. If the signal 21 is introduced into the control part 17*a* via the switching part 17*c* and then into the control unit 12 of the pinch roll group 2 via the switching part 17*e*, the speed of the driving motors 10, that is, the velocity with which the slab is driven, of the group 2 is adjusted to gradually increase within a safe range until the signal 21 disappears, so that the increase of the bulging phenomenon is effectively utilized to obviate the slippage.

The slip detector 20 receives signals from tachogenerators 22 connected to the respective braking rolls of the groups 5*a* and 5*b* and a signal from a tachogenerator 19*b* connected to the idling roll 18 following the second braking roll group 5*b*. It also receives a signal from the unit 15.

From the time that the connecting part C between the dummy bar DB and the casting slab S reaches the outlet end of the second braking roll group 5*b* to the time that the signal OFF is introduced from the material-detector 16, slip detector 20 compares the signal from the tachogenerator 22 with the signal from the tachogenerator 19*b* and calculates the difference therebetween, integrates the difference over a predetermined period, and, if the value of the integrated differences exceeds a preset upper limit value, introduces the signal 21 indicating occurrence of a slip into the control apparatus 17. The upper limit value can be preset to a value at which the level of the bath of a molten metal in the mold M will reach a dangerous condition, such as over-dlowing, or an allowable limit value for the surface characteristics of the slab S, etc.

Alternatively, switching part 17*c* can be used for back-up of the control part 17*b*. Thus, if the control action of the part 17*b* is not sufficient for removing the slippage so that there is still some slippage left, control can automatically be switched from the control part 17*b* to the control part 17*a* by means of a changeover signal from the control part 17*b*.

When the slippage disappears and the signal 21 from the detector 20 disappears and some time elapses from that time, the control apparatus 17 which has seriously issued signals according to the signal 21 gives instructions to the units concerned to immediately or gradually return to the original compression casting conditions.

As set forth hereinabove, in this example, slippage which occurs between the slab and the braking rolls during compression casting can be prevented so as to maintain the preferred compression casting properties without injuring the surface conditions of the slab whereby a cast slab having excellent quality of both the inside and outside thereof can be obtained.

In another aspect of this invention, when a slippage occurs between the driving pinch roll and the slab in the process wherein (a) the gap between the driving pinch rolls upstream of the straightening point and the braking rolls downstream of the straightening point in the slab guiding part of the continuous casting apparatus are set at predetermined values and (b) the braking operation is carried out by the braking rolls and the driving operation is carried out by the driving pinch rolls so as to impart compression in the longitudinal direction to the portion of the slab being cast which is at or near the straightening point; said slippage can be prevented by (1) stopping or gradually decreasing the braking action of the braking rolls and/or (2) ending the set condition of the roll gap of the driving pinch roll at which elippage is taking place and carrying out adjustment by a gradual increase of the pressure of the pinch rolls on the slab. An example of the apparatus for carrying out this method is shown in FIG. 2.

In FIG. 2 is shown a curved type continuous casting apparatus, in which M is a mold and 102 is a group of driving pinch rolls each having a respective driving motor 110 end tachogenerator 22, and which; are also provided with the respective screw units 103 having oil cylinders attached to serve as the roll gap adjusting mechanism. The numeral 104 indicates a pair of bending rolls provided at the straightening point and the 105 indicates a group of braking rolls. These braking rolls have each a motor 101 which is capable of driving the slab with a positive driving torque or instead generating electricity by being rotated by the moving slab S which is in pressure contact therewith so as to generate a braking force by a negative driving torque. There are also respective oil cylinder units 106 for the inner or upper rolls and ram-cylinder type spacers 107 between the inner or upper rolls and the outer or lower rolls as means for adjusting and setting the gap between the respective pairs of braking rolls. The group of rolls 105 is divided into a first braking roll group 105*a* and a second braking roll group 105*b*. The numeral 109 indicates a group of rolls provided between the mold M and the driving pinch roll group 102, and 109' indicates a group of rolls between the driving pinch roll group 102 and the first braking roll group 105*a*.

Control units are associated with the driving pinch roll group 102, and are constituted by an operation control unit 111 for controlling the units 103 for controlling the roll gaps and a control unit 112 for the driving motors. Similarly, the first and the second braking roll groups 105*a* and 105*b* are provided with operation control units 113*a* and 113*b* for controlling the roll gaps and with motor control units 114*a* and 114*b*, respectively. A unit 115 for locating the position of a material receives a signal from a pulse generator 108 connected to any one of the rolls of the group 109, which is then transmitted to a control apparatus 117 in response to an ON signal from a material-detector 116 provided on the inlet end of the group 102. The signal introduced from the pulse generator 108 is switched to a signal introduced from a pulse generator 119a connected to an idle roll 118 following the second braking roll group 105b at the time that the cast slab passes the roll 18 and the ON signal is changed to an OFF signal indicating passage of the end of the material. The unit 115 is reset to the original condition by means of an OFF signal indicating passage of the end of the material from a material detector 126 provided on the outlet side of the idle roll 118.

The control apparatus 117 controls the control units 111, 113a and 113b of the respective roll groups by a control part 117a for providing the proper gap for guiding the dummy bar before the casting begins. The thickness of the dummy bar is smaller than that of the slab in this example. The control unit 111 supplies oil under hydraulic pressure of 140 $Kg/cm^2$ to the oil cylinder of the screw units 103 to position the unit at the stroke end position to set the rolls at the proper size gap for guiding the dummy bar, the screw units 103 moving to a roll gap position corresponding to the thickness of the slab when the hydraulic pressure in the oil cylinder is released. The control units 113a and 113b are supplies with hydraulic oil at a pressure of 140 $Kg/cm^2$. The control units 113a and 113b operate oil cylinder units 106 engaging the upper rolls 105' and spacers 107 between the chocks of the rolls of the first braking roll groups 105a and the second braking roll group 105b to release the hydraulic pressure in the cylinders of the spacers 107 to allow the pistons of the spacers 107 to move down until the space between the rolls 105' and 105" is a minimum and simultaneously to supply hydraulic pressure to the space above the pistons of the oil cylinder units to move the pistons downward to move the upper rolls 105' in the downward direction. Thus, the roll gaps are set to a size suitable for guiding the dummy bar.

When the casting starts, the control part 117a of the control apparatus 117 receives a signal from the unit 115; indicating passage of the connecting part C between the dummy bar DB and the casting slab S; it compares the same with the patterns of roll arrangements of the pinch roll group 102, the first braking roll group 105a and the second braking roll group 105b, and it introduces a series of signals to the control units 111, 113a and 113b for changing or setting the roll gaps to those for guiding the slab each time the part C reaches the respective roll gap. In this way, the hydraulic pressure in the successive screw units 103 is reduced to zero or the original pressure and will return to their original position, whereby the roll gaps of the screw units are set to the thickness of the slab. On the other hand, the ram-cylinder type spacers 107 are operated by extending the spacers 107 by supplying the cylinders of the spacers 107 with hydraulic pressure to make the hydraulic pressure in the spacers 107 higher than that in the cylinders of the oil cylinder units 106. In addition, the control part 117b instructs the units 113a and 113b to change the relation of the hydraulic pressure between the spacers 107 and the oil cylinder units 106 so that the roll gaps between the upper and lower rolls 105' and 105" are suitable for guiding the slab being cast.

The control part 117c of the control apparatus 117 not only controls the driving motors 110 of the group 102 to start them to drive the slab but also switches the condition of motors 101 for the respective braking rolls from the driving condition for driving the dummy bar to rotation for braking for setting a predetermined braking action. This is done through the motor control units 114a and 114b and is in addition to the above described control of the change of the roll gap each time the position of said connecting part C reaches the respective roll gaps of the first and the second braking roll groups 105a and 105b.

The slab is then produced, moved by the roll group 102 at a predetermined velocity and subjected to a predetermined braking action by the roll groups 105a and 105b, whereby compression is exerted on the slab between the outlet end of the roll group 102 and the inlet end of the first braking roll group 105a. In the course of this compression casting, when a slippage occurs between the casting slab and one or more of the driving pinch rolls of the roll group 102, a signal 121 indicating occurrence of the slippage is supplied from a comparing unit 120 connected to the tachogenerators 122 connected to the respective rolls of the group 2 and to a tachogenerator 119b of connected to the idling roll 118 to the control part 117a via the switching part 117a of the control apparatus 117, and in accordance therewith the pinch rolls at which slippage is occurring are pressed against the slab S by the pressure of the hydraulic oil in the oil cylinder of the screw unit 103 of said pinch roll which is supplied at 40 $Kg/cm^2$, so that the slippage is obviated.

The comparing unit 120 sequentially receives the signals from the tachogeneraters 122 and 119b, calculates the difference and integrates the values of this difference over a predetermined period of time. If the value exceeds a preset upper limit, unit 120 introduces the slip-indicating signal 121 to the control part 117a via the switching part 117b of the control apparatus 117. This upper limit corresponds to the value at which the bath level in the mold M will overflow or be in some other dangerous condition or the allowable limit for the surface characteristics of the slab. The length of the period of time for integrating said values of difference may be based upon a value corresponding to the allowable limit for the surface characteristics of the slab or a value corresponding to the allowable limit for controlling the bath level in the mold M.

The screw-down operation of the oil cylinder of the screw units 103 at the time of the occurrence of slippage may be gradually or rapidly effected to the predetermined value.

The switching part 117b of the control apparatus 117 can be switched to supply the signal 121 to either the control part 117a or the control part 117c manually, or can be switched automatically when the casting velocity, the action, etc. reach a preset limit. Alternatively, it may be switched to supply the signal 121 to the control part 117c automatically in response to a signal from the control part 117a indicating that sufficient control cannot be achieved by control through control point 117a to eliminate slippage as a back-up for said part 117a.

When the slip-occurrence signal 121 is supplied, the control part 117c instructs the motor control parts 114a and 114b to gradually decrease the preset braking action of the individual braking rolls on a roll by roll basis or on the basis of unit groups of braking rolls until the slippage of the driving pinch roll disappears, or to immediately end the braking action and allow the braking rolls to rotate idly so that the slippage will disappear.

When the slip-occurrence signal 121 from the unit 120 disappears and a predetermined period of time elapses, the control part 117a acts to reduce the hydraulic pressure of the fluid supplied to the units 103 via the unit 111 gradually, stepwise or instantly. If the control part 117*c* operates when slippage occurs at the driving pinch rolls, the braking action is increased gradually, stepwise or instantly to the original braking action by the motor control units 114*a*, 114*b* and 112 whereby the compression casting is carried out again under the preferred conditions.

As described above, in this example, slippage between the slab and the driving pinch rolls for driving the slab during the compression casting can be overcome effectively so that problems such as over-flowing of the molten metal from the mold can be avoided and the control of the compression casting can be carried out very advantageously.

While this invention has been described with reference to specific examples thereof, it will be understood that suitable changes or modifications can be made without departing from the spirit of this invention.

Thus, in the above-described examples of this invention described in connection with FIGS. 1 and 2, the step of comparing the output of the tachogenerator 122 or 27 provided at each driving pinch roll or the tachogenerator 22 provided at each braking roll with the output of the tachogenerator 119*b* or 19*b* provided at the idle roll positioned at the tail end of the slab-guiding roll group has been described as a way to detect slippage between the slab and the driving pinch rolls or the braking rolls, but this invention is not limited thereto. It is possible, for example, to use a space-filter type absolute velocity detector instead of the tachogenerator 119*b* or 19*b*, or to detect the load or braking current of the driving pinch rolls or the braking rolls, which is then compared with a predetermined load current value or a predetermined braking current.

Furthermore, in the above examples, the rolls, near to and upstream of the straightening point are shown as being undriven, but this invention is not limited thereto. It is thus possible, for example, to provide the driving pinch rolls upstream of and near the straightening point so that the pressure casting is made possible to the tail end of the slab. It is also possible to use a driving system having a common electric source or individual electric sources as a means to drive the pinch rolls and braking rolls.

We claim:

1. A method for controlling slippage between a slab being cast and driving pinch rolls provided upstream of a straightening point and braking rolls provided downstream of the straightening point in a slab-guiding part of a continuous casting apparatus, comprising driving slab being cast by said driving pinch rolls and braking said slab by said braking rolls for guiding said slab and applying compression in the longitudinal direction of the slab to the part of said slab between the driving pinch rolls and the braking rolls, detecting slippage between the slab and one of said rolls, and reducing the braking action of the braking rolls in response to detection of slippage until the slippage is obviated.

2. The method as claimed in claim 1 wherein the braking action of the braking rolls is reduced gradually.

3. The method as claimed in claim 1 wherein the braking action of the braking rolls is reduced suddenly and completely.

4. A method according to claim 1 wherein the slippage is detected as occurring between the slab and a braking roll, and the step of reducing the braking action of the braking rolls comprises:

suddenly ending the braking action of the braking rolls;

the press down power of the braking roll is gradually increased;

the slab-drawing velocity of said driving pinch rolls is gradually increased;

whereby said slip is allowed to disappear.

5. A method according to claim 1 wherein the slippage is detected as occurring between the slab and a braking roll and the step of reducing the braking action of the braking roll comprises gradually reducing the braking action of the braking roll.

6. A method according to claim 1 further comprising gradually increasing the pressure of the braking roll.

7. A method according to claim 1 further comprising gradually increasing the velocity of the driving pinch rolls for increasing the velocity of the slab being drawn.

* * * * *